United States Patent [19]

Fujita

[11] 3,994,124

[45] Nov. 30, 1976

[54] ELECTRONIC TIMEPIECE

[75] Inventor: Kinji Fujita, Suwa, Japan

[73] Assignee: Kabushiki Kaisha Suwa Seikosha, Tokyo, Japan

[22] Filed: May 1, 1975

[21] Appl. No.: 573,651

[30] Foreign Application Priority Data

May 1, 1974 Japan ..... 49-48967

[52] U.S. Cl. ..... 58/23 R; 58/33; 58/50 R; 58/85.5

[51] Int. Cl.² ..... G04B 19/30; G04C 3/00

[58] Field of Search ..... 58/23 R, 33, 85.5, 50 R

[56] References Cited

UNITED STATES PATENTS

| | | | |
|---|---|---|---|
| 3,678,680 | 7/1972 | Fujita | 58/23 R |
| 3,686,880 | 8/1972 | Samejima | 58/23 R X |
| 3,733,810 | 5/1973 | Girard | 58/23 R X |
| 3,762,152 | 10/1973 | Marz | 58/23 R |
| 3,795,098 | 3/1974 | Fujita | 58/85.5 |
| 3,834,152 | 9/1974 | Nishimura et al. | 58/23 R |
| 3,852,952 | 12/1974 | Vittoz et al. | 58/23 R |
| 3,855,780 | 12/1974 | Kashio | 58/23 R X |
| 3,871,168 | 3/1975 | Maire et al. | 58/23 R |
| 3,886,726 | 6/1975 | Williams et al. | 58/23 R X |
| 3,889,460 | 6/1975 | Yasukawa et al. | 58/23 R |

*Primary Examiner*—Stanley J. Witkowski
*Attorney, Agent, or Firm*—Blum, Moscovitz, Friedman & Kaplan

[57] ABSTRACT

An electronic timepiece having function circuitry for performing at least two different functions, each responsive to a manually applied function signal and further circuity for automatically selecting the predetermined function circuit responsive to the function signal is provided. The electronic timepiece includes a timekeeping circuit adapted to produce low frequency timekeeping signals. A first switching circuit is adapted to be selectively actuated to selectively produce the function signal and a second switching circuit is disposed intermediate the first switching circuit and each of the function circuits. The second switching circuit is adapted for manual actuation to selectively apply the selectively produced function signals to one of the function circuits and further includes circuitry for receiving one of the low frequency timekeeping signals produced by the timekeeping circuitry and in response thereto automatically selected a predetermined function circuit for selective application of a function signal within a predetermined period after the second switching circuit effects in response to the manual actuation thereof, a selection of one of the function circuits for receiving the function signal.

12 Claims, 1 Drawing Figure

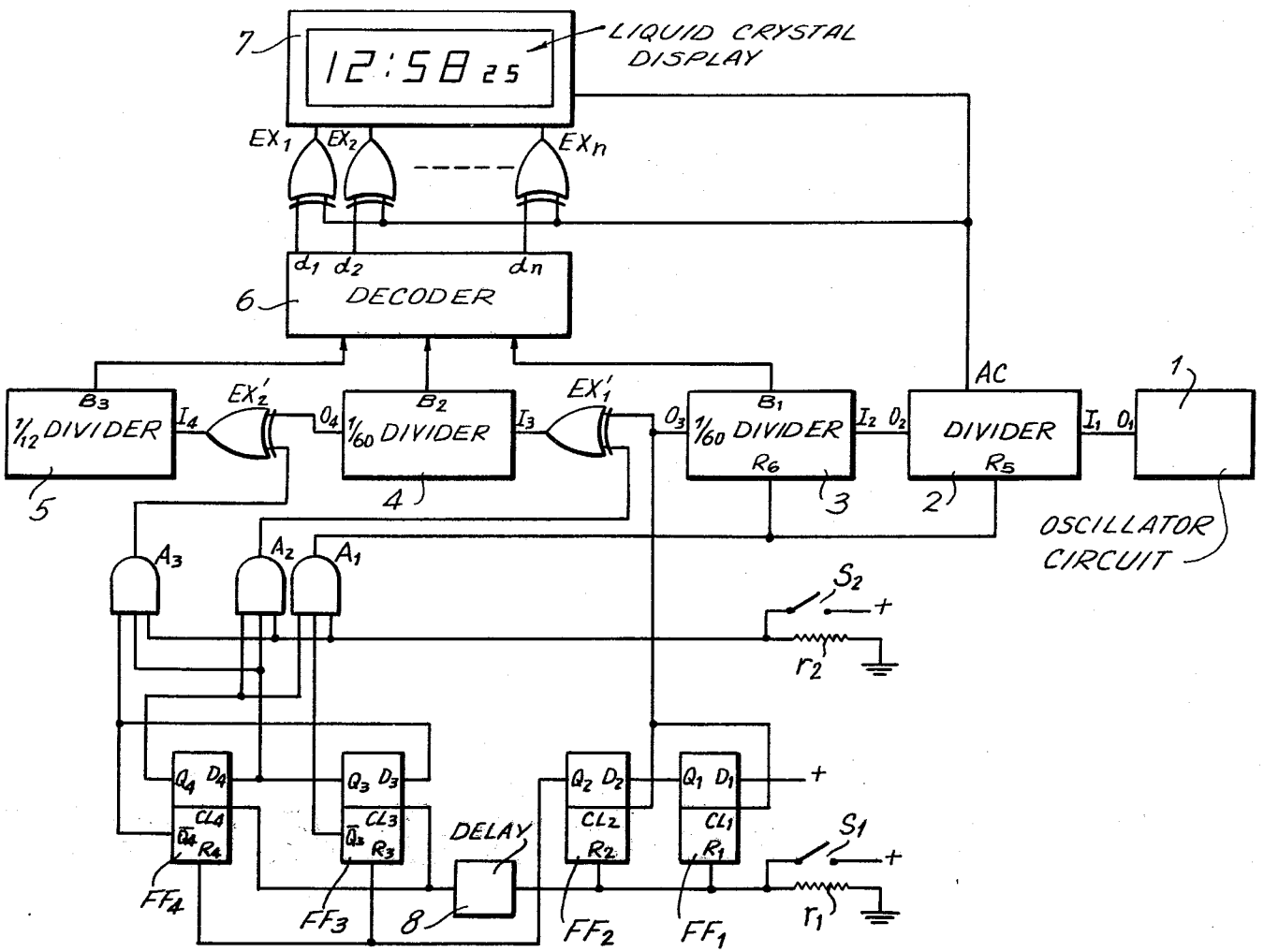
OSCILLATOR CIRCUIT
DIVIDER
DIVIDER
DIVIDER
DIVIDER
DECODER
LIQUID CRYSTAL DISPLAY
12:58 25
DELAY
FF1
FF2
FF3
FF4

ELECTRONIC TIMEPIECE

BACKGROUND OF THE INVENTION

This invention is directed to an electronic timepiece having function circuits for performing respective functions, and in particular to an electronic timepiece including circuitry for simplifying the selection of a function circuit and performance of the selected function.

The development of electronic timepieces has been based in no small part on the likewise development of IC technology. Nevertheless, as IC technology has advanced, so to has the sophistication and complexity of electronic timepieces utilizing same. Specifically, as the number of functions available to an electronic timepiece has increased, the circuitry for performing such functions has likewise increased. Nevertheless, in electronic wristwatches, the limited space available for electronic circuitry has required that the number of functions and the circuits and actuating elements (external switches) for performing respective functions be simple and few in number. Specifically, in an electronic wristwatch adapted to display the date, day, hour, minute and second, five functions are provided, requiring five function circuits and mechanical elements such as switches for effecting the five respective functions (correction or setting). Nevertheless, miniaturization of an electronic wristwatch including five such function circuits and switches coupled thereto is extremely difficult if the switches are of sufficient size to allow for reliable operation.

For the aforementioned example, one solution is to provide a first switch for selecting the specific digit of time displayed for correction, and providing a second switch for correcting the selected digit selected by the first switch. Such a development would require only two switches on the electronic wristwatch and would provide a simple mechanism which is easily miniaturized and provides for improved reliability. Nevertheless, because the digit selected by a first switch is not indicated, the likelihood of inadvertent correction of a wrong digit of time is likely. The provision of a digit indication system add substantial structure and cost to the timepiece.

SUMMARY OF THE INVENTION

Generally speaking, in accordance with the invention, an electronic timepiece including timekeeping circuitry for producing a low frequency timekeeping signal is provided. The electronic timepiece includes at least two function circuits, each said function circuit performing a respective function in response to a function signal selectively applied thereto. A first switching circuit is adapted to be selectively actuated to selectively produce a function signal. A second switching circuit is disposed intermediate the first switching circuit and each of the respective function circuits, the second switching circuit being adapted to selectively apply the selectively produced function signal to one of said respective function circuits, the second switching circuit further including circuitry adapted to receive one of the low frequency timekeeping signals and in response thereto automatically select a predetermined function circuit for selective application of a function signal within a predetermined period after the second switching circuit has effected a selection of a function circuit for receiving the function signal.

Accordingly, it is an object of this invention to provide an improved electronic timepiece wherein a plurality of functions are performed in a simplified manner.

Still a further object of this invention is to provide an improved electronic timepiece wherein selection of one of a plurality of functions is effected in a simplified manner.

Still another object of this invention is to provide an improved electronic wristwatch wherein a plurality of functions are reliably selected.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWING

For a fuller understanding of the invention, references had to the following description taken in connection with the accompanying drawing, in which:

The FIGURE is a block circuit diagram of an electronic timepiece including circuitry for reliably providing for the performance of a plurality of functions in accordance with the instant invention.

DETAILED DESCRIPTION OF THE PREFERRED EMBODIMENT

Reference is now made to the drawing, wherein an electronic digital display electronic timepiece is depicted. The electronic timepiece includes oscillator circuit 1 for producing a high frequency time standard signal $O_1$. A divider circuit 2 is adapted to receive the high frequency time standard signal at the input $I_1$ and in response thereto produce a one second signal $O_2$. 1/60 divider 3, 1/60 divider 4, and 1/12 divider 5, are series connected in a conventional manner to respectively produce one second timekeeping signal $B_1$, 1 minute timekeeping signal $B_2$ and 1 hour timekeeping signal $B_3$ in response to the one second signal $O_2$, 1 minute signal $O_3$, and 1 hour signal $O_4$respectively applied to the dividers. The timekeeping signals $B_1$, $B_2$ $B_3$ are BCD signals and are applied to a decoder circuit 6, which circuit in turn applies the decoded BCD signals as first inputs $d_1$ through $d_n$ to EXCLUSIVE OR gates $EX_1$ through $EX_n$. The other input to the EXCLUSIVE OR gates $EX_1$ through $EX_n$ is an intermediate frequency signal AC produced by the divider circuit 2, usually on the order of 32 to 64 Hz. The output terminal of each of the EXCLUSIVE OR gates $EX_1$ through $EX_n$ is coupled to segmented electrodes of a liquid crystal display panel 7, which electrodes form conventional 7 bar display elements. The liquid crystal display panel is provided with a common electrode (not shown) also adapted to receive the Ac signal produced by divider circuit 2. Accordingly, since the common electrode is adapted to receive the AC signal, the segmented electrodes corresponding to the output signals $d_1$ through $d_n$ of the decoder circuit 6 having a 1 state have applied thereto an $\overline{AC}$ signal having a phase opposite to that of the common electrode to thereby effect a lighting of the liquid crystal display segments. Accordingly the remaining segment electrodes corresponding to $d_1$ through $d_n$ having a state of 0 have applied thereto a signal having the same phase as the common electrode, and hence are not lighted.

As is specifically detailed below, three specific correction functions are selected by a first function selecting switch $S_1$, whereafter the function selected is performed by actuation of a second manually actuated switch $S_2$. Specifically, function selecting switch $S_1$ is directly coupled to the reset terminals $R_1$ and $R_2$ of D-type flip-flop circuits $FF_1$ and $FF_2$.

Additionally, function selection switch $S_1$ is coupled through a delay circuit 8 to two further D-type flip-flop circuits $FF_3$ and $FF_4$. D-type flip-flop circuits $FF_1$ through $FF_4$ operate in a conventional manner whereby a change in state from 0 to 1 in the signal applied to the clock input terminal CL will effect a writing of the data applied to the D terminal at the Q terminal. Accordingly, when function selection switch $S_1$ is closed, flip-flops $FF_1$ and $FF_2$ are reset to 0, which in turn sets the terminal $Q_2$ of flip-flop $FF_2$ to 0 to thereby effect an application of a 0 reset pulse to terminals $R_3$ and $R_4$ of flip-flops $FF_3$ and $FF_4$. Because of the delay circuit 8, the positive or 1 pulse applied by the function selection switch $S_1$ is respectively applied to terminals $CL_3$ and $CL_4$ of flip-flops $FF_3$ and $FF_4$ at a short time after the 0 reset pulses applied to the terminals $R_3$ and $R_4$ to thereby effect a changing of the states of $FF_3$ and $FF_4$. Accordingly, flip-flops $FF_3$ and $FF_4$ are set to four different states 0, 1, 2, and 3 in response to four selective actuations of the function selection switch $S_1$. The four states are detailed in the table below, it being noted that the terminology of first, second, third and fourth ON refers to the number of closings of the function selection switch $S_1$.

TABLE 1

| State | $S_1$ | $Q_3$ | $Q_4$ |
|---|---|---|---|
| 0 | | 0 | 0 |
| 1 | the first ON | 1 | 0 |
| 2 | the second ON | 1 | 1 |
| 3 | the third ON | 0 | 1 |
| 0 | the fourth ON | 0 | 0 |

The output of $Q_3$, $\overline{Q}_3$ and $Q_4$, $\overline{Q}_4$ are respectively coupled to input terminals of AND gates $A_1$, $A_2$, $A_3$ to effect a selective opening and closing thereof. The opening of AND gates $A_1$, $A_2$ and $A_3$ correspond to states 1, 2 and 3 detailed in Table 1 above, and hence allows a function signal to be applied by respective AND gates in response to the actuation of a function performance switch $S_2$. Moreover, when gates $A_1$ to $A_3$ are at the state 0, each of the gates remain closed, and actuation of function performance switch $S_2$ has no effect.

The respective functions performed by opening AND gates $A_1$, $A_2$ and $A_3$ are as follows. In response to state 1 wherein the function selection switch $S_1$ is closed once, and AND gate $A_1$ is opened if function performance switch $S_2$ is actuated, a signal is applied to reset terminals $R_5$ and $R_6$ of divider circuit 2 and 1/60 divider circuit 3 to effect a resetting thereof, and hence a resetting of the seconds counted thereby. Similarly, in the 2 (3) state, AND gates $A_2$ ($A_3$) are open, and the actuation of function performance switch $S_2$ effects the addition of a pulse to input terminals $I_3$ ($I_4$) of minutes 4 (hours 5) dividers through EXCLUSIVE OR gates $EX'_1$ ($EX'_2$), to thereby effect a correction of the respective minute (hour) dividers Nevertheless, because the state last selected is not indicated by the timepiece, a likelihood that the wrong function will be inadvertently performed is likely to occur.

Accordingly, in addition to applying a reset signal to the flip-flops $FF_3$ and $FF_4$, the CL terminals of flip-flops $FF_1$ and $FF_2$ are coupled to the ouput of the 1/60 divider 3 and are adapted to receive the one minute output signal $O_3$ produced thereby. Flip-flops $FF_1$ and $FF_2$ are reset to zero by each actuation of function selection switch $S_1$. Moreover, output terminal $Q_2$ of flip-flop $FF_2$ is set to 1 within 1 to 2 minutes after the last selective actuation of the function selection switch, thereby causing flip-flops $FF_3$ and $FF_4$ to be reset to 0 and to thereby produce a 0 state hence closing each of the AND gates $A_1$ through $A_3$ to thereby prevent any inadvertent correction of the type detailed below by actuation of switch $S_2$ and to further allow an operator to provide more reliable correction by recognizing that the electronic timepiece is in a 0 state prior to any desired correction. Accordingly, no matter what state $FF_3$ and $FF_4$ are placed in by correction of the timepiece, the flip-flops will be automatically returned to the 0 state within a period of one or two minutes after the last selective actuation of the function selection switch $S_1$ to thereby provide a simple and reliable multi-function selection feature in an electronic timepiece.

Although the instant invention has been disclosed herein with respect to a simple electronic timepiece having three correction functions for correcting the display of hours, minutes and seconds, it is noted that the instant invention is adapted for use in more complex timepieces having many more time periods to be corrected, thereby increasing the significance of the automatic return feature.

Moreover, although the circuitry for selecting a plurality of functions has been described hereinabove with respect to correction circuits, same is equally suitable for performing various functions in an electronic timepiece. For example in an alarm timepiece, when it is necessary to set the alarm and have same displayed by the digital display panel, such function selection means are particularly adapted for use therewith to automatically return the display to normal time display after a predetermined period. Moreover, in chronographic timepieces, and timepieces adapted to produce different time zone information, the respective function can be selected in accordance with the instant invention in a more reliable manner. Thus, in the case of a chronographic timepiece, the display can be used to display actual or elapsed time and the function selection means can automatically return the timepiece to display function after a period of time. In a timepiece where time in different time zones can be selectively displayed, the display can be returned to present time display automatically.

It will thus be seen that the objects set forth above, among those made apparent from the preceding description, are efficiantly attained and, since certain changes may be made in the above constructions without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In an electronic timepiece including oscillator means for producing a high frequency time standard signal, timekeeping circuit means adapted to produce low frequency timekeeping signals in response to said high frequency time standard signal applied thereto, the improvement comprising at least two function means, each said function means performing a respective function in response to a function signal selectively applied thereto; first switching means adapted to be selectively actuated to selectively produce a function signal, and second switching means disposed intermediate said first switching means and each of said function means, said second switching means being adapted to select any one of said function means for receiving said selectively produced function signal, said second switching means further including circuit means adapted to receive one of said low frequency timekeeping signals and in response thereto automatically select a predetermined function means for receiving said selectively produced function signal within a predetermined period after said second switching means has effected a selection of one of said function means to receive said selectively produced function signal.

2. An electronic timepiece as claimed in claim 1, wherein said second switching means includes at least two logic gating means, each said logic gating means being coupled intermediate a respective function means and said first switching means, each said logic gating means being selectively opened or closed to allow a function signal to be applied therethrough.

3. An electronic timepiece as claimed in claim 2, wherein said second switching means further includes first counter means coupled to each of said logic gating means, said first counter means being selectively actuated to selectively open and close said logic gating means to select one of said function means to receive said selectively applied function signal.

4. An electronic timepiece as claimed in claim 3, wherein said second switching circuit means includes second counter means for receiving said timekeeping signal, said second counter means being coupled to said first counter means and in response to said timekeeping signal automatically setting said first counter means to select a predetermined opening and closing of each of said logic gating means within a predetermined time period after said second switching means has effected a selection of a function means to receive said selectively applied function signal.

5. An electronic timepiece as claimed in claim 4, wherein said second switching means includes a manually operated switch coupled to said first and second counters for effecting selection of one of said function means to receive said selectively applied function signals in response to each actuation thereof.

6. An electronic timepiece as claimed in claim 5, wherein said timekeeping circuit means includes a plurality of series-connected divider stages, certain of said divider stages being adapted to produce timekeeping signals, display means coupled to said certain divider stages for displaying time in response to said timekeeping signals, each said function means being respectively coupled to one of said certain divider stages having said digital display means associated therewith.

7. In an electronic timepiece including oscillator means for producing a high frequency time standard signal, time-keeping circuit means adapted to produce low frequency time-keeping signals in response to said high frequency time standard signal applied thereto, the improvement comprising at least two function means, each said function means performing a respective function in response to a function signal selectively applied thereto; first switching means adapted to be selectively actuated to selectively produce a function signal, and second switching means disposed intermediate said first switching means and each of said function means, said second switching means being actuated to a first state to prevent application of a selectively produced function signal to any of said function means, and being further adapted to be actuated to at least two further states to selectively apply said selectively produced function signals to one of said function means, said second switching means further including circuit means adapted to receive one of said low frequency timekeeping signals and in response thereto automatically select said first state for preventing the selective application of a function signal to any of said function means within a predetermined period after said second switching means has effected an actuation to one of said first state and further states.

8. an electronic timepiece as claimed in claim 7, wherein said second switching means includes at least two logic gating means, each logic gating means being coupled intermediate said respective function means and said first switching means, each said logic gating means being selectively opened or closed to allow a function signal to be appled therethrough.

9. An electronic timepiece as claimed in claim 8, wherein said second switching means further includes first counter means coupled to each of said logic gating means, said first counter means being selectively actuated to a first state to open each of said logic gating means and to further states for selectively opening and closing each of said logic gating means to select one of said function means to receive said selctively applied function signal.

10. An electronic timepiece as claimed in claim 9, wherein said second switching circuit means includes second counter means for receiving said time keeping signal, said second counter means being coupled to said first counter means and in response to said time-keeping signal automatically setting said first counter means to select said first state and effect a closing of each of said logic gating means within a pre-determined time period after said second switching means has effected a selection of one of a first state and further states.

11. An electronic timepiece as claimed in claim 10, wherein said second switching means includes a manually operated switch coupled to said first and second counters for effecting selection of one of said states in response to each actuation thereof.

12. An electronic timepiece as claimed in claim 11, wherein said time-keeping circuit means includes a plurality of series-connected divider stages, certain of said divider stages being adapted to produce time-keeping signals, display means coupled to said certain divider stages for displaying time in response to said time-keeping signals, each said function means being respectively coupled to one of said certain divider stages having said digital display means associated therewith.

* * * * *